US006039145A

United States Patent [19]

Ogura et al.

[11] Patent Number: 6,039,145

[45] Date of Patent: Mar. 21, 2000

[54] DIAPHRAGM-EDGE INTEGRAL MOLDINGS FOR SPEAKERS, ACOUSTIC TRANSDUCERS COMPRISING SAME AND METHOD FOR FABRICATING SAME

[75] Inventors: Takashi Ogura, Osaka; Kousaku Murata, Kobe, both of Japan

[73] Assignee: Matsushita Electric Industial Co., Ltd., Osaka, Japan

[21] Appl. No.: 09/000,922

[22] Filed: Dec. 30, 1997

Related U.S. Application Data

[62] Division of application No. 08/266,924, Jun. 28, 1994, Pat. No. 5,744,761.

[30] Foreign Application Priority Data

Jun. 28, 1993 [JP] Japan ..... 5-156676
Jun. 27, 1994 [JP] Japan ..... 6-143716

[51] Int. Cl.[7] ..... G10K 13/00

[52] U.S. Cl. ..... 181/167; 181/169; 181/170; 181/172

[58] Field of Search ..... 181/167, 169, 181/170, 171, 172, 173, 174

[56] References Cited

U.S. PATENT DOCUMENTS

| | | |
|---|---|---|
| 1,872,583 | 8/1932 | Hawley . |
| 2,502,853 | 4/1950 | Keddie . |
| 2,873,813 | 2/1959 | Haerther, Jr. et al. . |
| 4,076,098 | 2/1978 | Ward . |
| 4,140,203 | 2/1979 | Niguchi et al. . |
| 4,410,768 | 10/1983 | Nakamura et al. . |
| 4,582,163 | 4/1986 | Catthoor . |
| 4,646,874 | 3/1987 | Baitcher et al. . |
| 4,772,513 | 9/1988 | Sakamoto et al. . |
| 5,031,720 | 7/1991 | Ohta et al. . |
| 5,241,140 | 8/1993 | Itoh et al. . |

FOREIGN PATENT DOCUMENTS

| | | |
|---|---|---|
| 0 264 830 A3 | 4/1988 | European Pat. Off. . |
| 0 508 596 A1 | 10/1992 | European Pat. Off. . |
| 1282999 | 11/1989 | Japan . |
| 4-326298 | 11/1992 | Japan . |
| 2 094 701 | 9/1982 | United Kingdom . |

*Primary Examiner*—Khanh Dang
*Attorney, Agent, or Firm*—McDermott, Will & Emery

[57] ABSTRACT

A diaphragm for speakers comprises a self-support, shaped body including a tightly woven synthetic polymer fiber cloth substrate which has, at least a diaphragm portion and edge portion shaped integrally with and extending from the diaphragm portion. The diaphragm portion of the cloth substrate had a polymer resin at least partially impregnated therein and the edge portion has a relatively flexible polymer material at least partially impregnated therein so that the edge portion is lower in stiffness than the diaphragm portion. The diaphragm-edge integral molding is fabricated by applying the respective types of polymers to the diaphragm and edge portions of the cloth substrate and subjecting the applied substrate to hot pressing in a mold capable of forming the integral molding. When applied as dynamic speakers, the integral molding exhibits a broad frequency band, low distortion rates and high sound quality. The stiffness difference between the diaphragm and edge portions may be created by using one type of thermoplastic resin which is applied to the diaphragm and edge portions in different amounts.

14 Claims, 6 Drawing Sheets

DIAPHRAGM-EDGE INTEGRAL MOLDINGS FOR SPEAKERS, ACOUSTIC TRANSDUCERS COMPRISING SAME AND METHOD FOR FABRICATING SAME

This application is a Divisional of application Ser. No. 08/266,924 filed Jun. 28, 1994 now U.S. Pat. No. 5,744,761.

BACKGROUND OF THE INVENTION

1. Field of the Invention

This invention relates to diaphragms for speakers or acoustic transducers and more particularly, to integrally molded diaphragm-edge articles which are adapted for use in acoustic output apparatus. The invention also relates to methods for fabricating the diaphragm-edge integral moldings and to acoustic transducers comprising the same.

2. Description of the Prior Art

As is well known in audio and allied industries, digitalization of reproduction music sources has advanced materially. This makes a great demand for speakers, which are higher in sound quality than conventional counterparts, for use in acoustic output apparatus.

One of physical properties required for the diaphragm of speakers is stiffness of diaphragm material. The improvement of the stiffness contributes to suppressing partial vibrations such as surface resonance and reducing distortion rates, ensuring reproduction of higher frequency components. The physical characteristics required for materials for the edge portion include flexibility, by which distortions with the diaphragm are suppressed, enabling reproduction of lower frequency components. In order to satisfy both requirements, usual practice is to use a structure which makes use of different types of materials for both diaphragm and edge or surround portions. For instance, with microspeakers having a diameter of not larger than 40 mm, it is usual from the standpoint of their structural arrangement and fabrication cost to integrally mold diaphragm and edge portions from a single material such as a film of polyethylene terephthalate resin (PET) or polycarbonate (PC). However, the integral molding from such a single material is disadvantageous in that if the stiffness of the diaphragm is increased in order to improve a high-band threshold frequency, $f_h$ the edge increases in stiffness, so that a minimum resonance frequency, $f_o$, is simultaneously shifted toward a higher frequency band. On the contrary, when the stiffness of the edge is decreased in order to decrease the value of $f_o$ the stiffness of the diaphragm is lowered with $f_h$ being shifted toward a lower frequency band. More particularly, it is not possible to satisfy the requirements for both diaphragm and edge, which are contrary to each other, in order to realize broad band frequency characteristics, thus resulting in narrow band frequency characteristics. In addition, limitation is placed on the inherent movements of the edge and the diaphragm of speaker as will be required by application of reproduction signals, generating an excessive distortion, Hence, it has been difficult to stably reproduce HiFi audio sound from compact disks and PCM sound sources in a frequency band of from 20 to 20,000 Hz.

Moreover, with speakers having a larger diameter and making use of different types of materials for the diaphragm and edge, respectively, the integral molding of diaphragm-edge has not been generally employed because of the difficulty in establishing molding or shaping conditions of different types of materials and the complication of molding apparatus. At present, diaphragm and edge pieces are separately fabricated, after which both pieces are bonded together through a bonding step. This presents many problems such as a problem of separation between the once bonded pieces and a problem on bonding agents or adhesives from which volatile solvents undesirably evaporate.

SUMMARY OF THE INVENTION

It is accordingly an object of the invention to provide an integrally molded diaphragm-edge article which overcomes the problems involved in the prior art and which is adapted for use in all types of dynamic speakers.

It is another object of the invention to provide an integrally molded diaphragm-edge article which satisfies requirements in physical characteristics for a diaphragm and an edge of speaker which are contrary to each other whereby the molded article exhibits a higher frequency band and a higher sound quality than existing diaphragms each made of a single polymer resin film.

It is a further object of the invention to provide a simple process for fabricating integrally molded diaphragm-edge articles.

It is a still further object of the invention to provide an integrally molded diaphragm-edge articles wherein a diaphragm portion is imparted with an intended degree of stiffness whereby when such a diaphragm is applied to a closed speaker unit as used in telephone sets, a high-cut frequency can be set at an optional level.

According to one embodiment of the invention, there is provided a diaphragm for speakers which comprises a self-supporting, shaped body including a tightly woven synthetic polymer fiber cloth substrate which has, at least, a diaphragm portion and an edge portion shaped integrally with and extending from the diaphragm portion wherein the diaphragm portion of the cloth substrate has a polymer resin at least partially impregnated therein to impart stiffness to the diaphragm portion and the edge portion has a polymer material which is flexible relative to the polymer resin and is at least partially impregnated therein so that the edge portion is lower in stiffness than the diaphragm portion.

It is preferred that the diaphragm portion has stiffness sufficient to exhibit a high threshold frequency not less than 20,000 Hz. It is also preferred that the edge portion is flexible sufficient to provide a minimum resonance frequency smaller than 400 Hz.

In this embodiment, the polymers at least partially impregnated in the diaphragm portion and the edge portion differ in type from each other in order to realize the characteristic properties required therefor, respectively. For the diaphragm portion, the polymer should be rigid in nature when solidified after hot pressing or thermoforming press for obtaining the integral molding. On the other hand, the polymer used in the edge portion should be relatively flexible after solidification.

The stiffness in the diaphragm portion may vary depending on the type of polymer resin used and the amount of a polymer being impregnated in the diaphragm portion. The amount control of the polymer is especially useful when the integral molding is applied for use in closed type speakers such as speaker units for telephone sets or headphones. This is because the stiffness of the diaphragm portion can be arbitrarily changed or controlled by proper control in amount of a polymer being applied, permitting a high-cut frequency to be set at a desired level.

Further, the stiffness may be increased by lamination of a reinforcing layer on the woven cloth substrate through a thermoplastic polymer resin. The reinforcing layer may be made of the woven cloth used as the substrate. Alternatively, inorganic metal compounds or diamond may preferably be deposited as a thin film on one side of the diaphragm portion by vacuum deposition or other techniques.

In addition, if it is desired to further improve acoustic and physical characteristics such as partial resonance, internal loss, stiffness, distortion rates, flatness and sound pressure, predetermined portions of the woven cloth substrate should preferably be coated or impregnated with polymer resins or other agents.

In the above embodiment of the invention, the materials used for impregnation in the diaphragm and edge portions have been stated as differing from each other in order to impart stiffness and flexibility to the respective portions. The impartment may be performed by applying to the diaphragm and edge portions only one thermoplastic polymer resin in different amounts so that the diaphragm portion is higher in stiffness than the edge portion. This type of the integral molding is particularly suitable for use in a closed type speaker which requires a high-cut frequency at a certain level as will be described hereinafter. In this case, in order to avoid a high degree of stiffness to the edge portion, a relatively small amount of a thermoplastic polymer resin is applied to the edge portion. In this and foregoing embodiments, the present invention is characterized in that the diaphragm and edge portions are integrally molded and the diaphragm portion is higher in stiffness than the edge portion.

According to another embodiment of the invention, there is also provided a method for fabricating a diaphragm for speakers which comprises a self-supporting, shaped body including a tightly woven synthetic polymer fiber cloth substrate which has, at least, a diaphragm portion and an edge portion shaped integrally with and extending from the diaphragm portion wherein the diaphragm portion of the cloth substrate has a polymer resin at least partially impregnated therein in order to impart stiffness to the diaphragm portion and the edge portion has a flexible polymer material at least partially impregnated therein so that the edge portion is lower in stiffness than the diaphragm portion, the method comprising applying the polymer resin and the flexible polymer material in patterns, respectively, corresponding to the diaphragm portion and the edge portion on the cloth substrate and subjecting the thus applied substrate to thermoforming press or hot press in a mold capable of forming a diaphragm-edge integral molding. The applications of the respective polymers to the diaphragm portion and the edge portion may include impregnation in or coating on or attachment of film to the substrate. For the impregnation or coating, the respective resins are usually dissolved in solvents therefor at appropriate concentrations.

Preferably, a plurality of the molding patterns are printed on the substrate by screen printing and hot pressed to obtain a plurality of integral moldings at one time. The molding pattern or patterns of the respective polymers alone should preferably be melted during the course of the hot pressing, thereby permitting the melt to be impregnated at least partially in the cloth substrate.

According to a further embodiment of the invention, there is provided an acoustic transducer which comprises an acoustical driving means and a diaphragm driven by the driving means, the diaphragm composed of the integral molding of the type set out hereinabove. Preferably, the acoustic transducer comprises a closed type speaker having a moving coil as the driving means.

DETAILED DESCRIPTION AND EMBODIMENTS OF THE INVENTION

Figure 1:
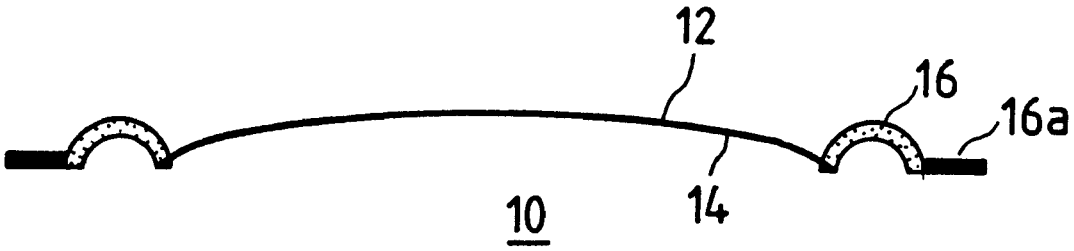
FIG. 1 is a schematic side view of a diaphragm-edge integral molding according to one embodiment of the invention.

Reference is now made to the accompanying drawings and particularly, to FIGS. 1 to 4 showing EMBODIMENTS of the invention, in which like reference numerals, respectively, indicate like parts or members.

In FIG. 1, there is generally indicated as 10 a self-supporting integral molding of diaphragm-edge. The molding 10 includes a tightly woven, synthetic fiber cloth substrate 12. The substrate 12 has a diaphragm portion 14 and an edge portion 16 as shown. The diaphragm portion 14 should be stiff in nature. For this purpose, the portion 14 is applied with a rigid polymer resin so that required acoustic and physical characteristics are imparted to the diaphragm portion 14. More particularly, the cloth substrate in the diaphragm portion 14 may be at least partially or fully impregnated with rigid polymer resins. The term "at least partially" used herein is intended to mean that the rigid resin is not only completely impregnated in the cloth substrate, but also partially impregnated in the substrate while leaving part of the resin as coated on the cloth substrate.

On the other hand, the edge portion 16 should be elastic or flexible at least relative to the diaphragm portion 14 the to prevent undesirable distortions with the diaphragm portion 14. To this end, the substrate 12 in the edge portion 16 is applied with a flexible polymer or rubber material. More particularly, the edge portion 16 may be at least partially impregnated with a flexible polymer or rubber material, like the diaphragm portion 16. The edge portion 16 has a peripheral edge **16*a* at which the integral portion is fixed. Accordingly, the peripheral portion 16*a* should be rigid and be applied with a rigid polymer resin in the same manner as with the diaphragm portion 14, The diaphragm-edge integral molding may have a desired form generally used for this purpose and may be in a dome or cone form. The molding is made of a tightly woven cloth substrate having a very close weave. As set out hereinabove, the substrate is applied with different types of resins at intended portions thereof. The cloth substrate 12 in the diaphragm portion 14** and the edge portion is sealed with the respective resins or rubbers, so that the diaphragm portion is prevented from passage of air therethrough, thus contributing to a lower internal loss.

The tightly woven cloth substrate 12 is made of synthetic resin fine fibers. Such a cloth substrate is effective in establishing high stiffness and exhibits a high internal loss owing to mutual friction of the fibers in the woven cloth substrate and is light in weight because of the spaces among the fibers in the cloth. Examples of the synthetic resin fibers include those fibers of polyolefins such as polyethylene, polypropylene and the like, polyesters such as polyethylene terephthalate, polyamide resins such as nylon 11. Of these polyester are preferred. Preferably, the threads or fibers are uniaxially oriented by stretching under heating conditions by several tens % or over after spinning.

Figure 2:
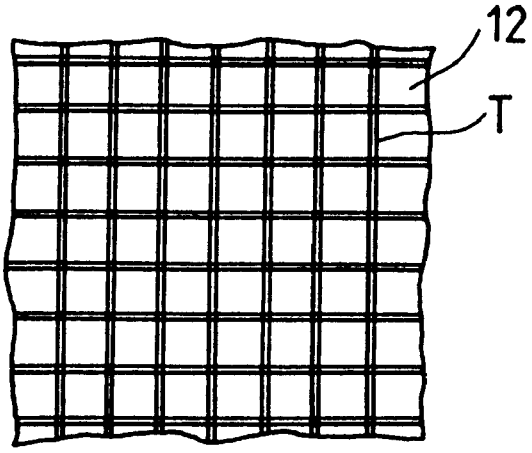
FIG. 2 is a schematic view illustrating a woven cloth substrate having a check pattern of thick fibers.

The cloth substrate may have various types of weaves which may comprise threads made of a single or multiple fiber. The cloth substrate may have a weave structure including a plain weave, a twill weave, a plain dutch weave, crimps or the like weave structures. Of these, a plain weave is preferred. The threads used for the cloth substrate may be the same or different in size and may be of the same size and composition. In general, the threads have a denier ranging from 20 to 200. From the standpoint of the physical properties of a final integral molding, it is preferred that the cloth substrate has a weave structure which is made of different sizes of threads. In the case, larger-size or thicker threads which are woven in at equal intervals of 3 to 10 mm in vertical and horizontal directions as shown in FIG. 2. By this, the resultant cloth structure may have am appropriate degree of stiffness. In FIG. 2, a part of the woven cloth substrate 12 is shown in which larger-size fibers or threads T alone are shown in a check pattern. The weave structure as shown in FIG. 2 is effective when using fine fibers having a denier of from 20 to 50. In the case, thicker fibers woven in the pattern should have a denier of 60 to 200.

The cloth substrate should preferably have a thickness of from 30 to 200 $\mu$m.

The diaphragm portion 14 is at least partially impregnated with a polymer resin. Examples of the polymer resin used to impart stiffness to the cloth substrate include thermosetting resins such as epoxy resins, phenolic resins, urea resins, melamine-formaldehyde resins, unsaturated polyester resins and the like, and rigid thermoplastic resins which are sufficient to impart stiffness to the cloth substrate after cooling to ambient temperatures. Examples of such thermoplastic resins include acrylic resins such as methyl acrylate resin, methyl methacrylate resin, ethyl acrylate resin, ethyl methacrylate resin, urethane resins, polyvinyl chloride, polypropylene, ABS resins, polyimides, polycarbonates and the like. Of these, epoxy resins, acrylic resins and urethane resins are preferred.

When the thermosetting resins are used, curing agents may be used in combination as is well known in the art. For instance, amines, polyamides and acid anhydrides may be used when epoxy resins are used.

The stiffness imparted to the cloth substrate may be expressed, to some extent, in terms of high threshold frequency. In the practice of the invention, the high threshold frequency is preferably in the range of not lower than 20,000 Hz.

The amount of the applied resin, whichever thermoplastic or thermosetting, is in the range of from 20 to 60 g/m$^2$, preferably from 20 to 40 g/m$^2$, within which a desired degree of stiffness can be imparted after molding through hot pressing.

The edge portion 16 is also applied with flexible polymer or rubber materials to prevent undesirable distortions of the diaphragm portion. To this end, the polymer or rubber materials are at least partially impregnated in the cloth substrate corresponding to the edge portion 16. Such materials include acrylic resins such as those indicated with regard to the diaphragm portion, urethane polymers, rubbers such as styrene-butadiene rubber (SBR), acrylonitrile-butadiene rubber (NBR), isobutylene-isoprene rubber (IIR), ethylene-propylene rubber (EPM), acrylic rubber, polyester-modified urethane rubber, silicone rubbers a,nd the like. When acrylic resin and urethane polymers are used in the edge portion, thermosetting resins are preferably used in the diaphragm portion. The amount of the resin or rubber in the edge portion is preferably in the range of from 5 to 50 g/m$^2$.

The peripheral edge 16*a* should be rigid and may be treated substantially in the same manner as with the diaphragm portion 14.

In the above embodiment, the diaphragm portion and the edge portion are impregnated with different types of resin materials. In order that different levels of stiffness are imparted to the respective portions, the portions may be applied with one thermoplastic polymer resin in different amounts. More particularly, when a thermoplastic polymer resin is applied to the edge portion in amounts which are smaller than to the diaphragm portion but do not impede flexibility so as to prevent undesirable distortions from occurring. The thermoplastic polymer resins may be those set out hereinbefore. The amount of the resin is generally in the range of 15 to 50 g/m$^2$ in the diaphragm portion and in the range of from 5 to 20 g/m$^2$ in the edge portion. Within these ranges. different amounts of the resin are, respectively, applied to the diaphragm and edge portions so that the diaphragm portion has stiffness higher than the edge portion.

Fabrication of the integral moldings according to the embodiments of FIG. 1 is then described.

The cloth substrate 12 is first provided, on which different types of polymer or rubber materials are applied to the cloth substrate 12 in a pattern including a diaphragm portion and an edge portion. A relatively rigid polymer resin is usually applied to the diaphragm portion and a relatively flexible rubber or polymer material is applied to the edge portion. Subsequently, the thus applied substrate 12 is subjected to hot press or thermoforming press in a mold to obtain a diaphragm-edge integral molding.

The different types of polymer or rubber materials for the diaphragm and edge portions may be dissolved in solvents therefor and printed in a pattern such as by screen printing. For this purpose, the concentrations of the respective solutions vary depending on the amounts of the respective polymer or rubber materials applied to the cloth substrate and are usually in the range of several to several tens wt %, respectively. After completion of the printing of the respective solutions, the solvent is evaporated or allowed to evaporate. Solvents used to make the solution are not critical in kind provided that the polymer or rubber materials are soluble therein.

Alternatively, films of the polymer or rubber materials, respectively, used for application to both portions may be attached to the cloth substrate to form a desired pattern.

After the formation of the diaphragm-edge pattern on the cloth substrate, the substrate is subjected to thermoforming press or hot press in a mold capable of forming a diaphragm-edge integral molding at a temperature of from 180 to 200° C. under a compression pressure of from 20 to 60 kg/cm$^2$. By this, the printed or coated pattern or film pattern is melted and impregnated in the cloth substrate. The degree of the impregnation may vary depending on the temperature, pressure and time conditions. If it is desirable to impregnate the resin pattern completely, higher temperature and higher pressure within the above ranges and a longer time are used. Additionally, the gap between male and female molds may be so determined as to be substantially equal to or slightly smaller than the thickness of the cloth substrate, ensuring complete impregnation. If partial impregnation is desired, the gap is determined as to be slightly greater than the cloth thickness.

The upper temperature limit is determined so that the cloth substrate made of the afore-defined materials is not melted down along with the resin pattern. The lower limit of the temperature is determined such that the rubber or polymer materials can be melted within a relatively short time. If thermosetting resins are used in the diaphragm portion, they call be cured under such conditions as set out above. The pressing time is usually in the range of from 5 to 60 seconds.

The resultant integral molding exhibits good acoustic characteristics required for all types of dynamic speakers, including a minimum resonance frequency of not higher than 400 Hz, a high threshold frequency not lower than 20,000 Hz, a sonic velocity of from 150 to 300 $m^2$/second and an internal loss of 0.05 to 0.1 although they may vary depending on the types and amounts of polymer and/or rubber materials used for the diaphragm and edge portions, respectively. The integral molding usually has a dome or cone form and may be shaped in any desired form.

Especially, when the diaphragm-edge pattern is formed on the cloth substrate by printing, it is preferred to print a plurality of the patterns on a large-size cloth substrate at one time, followed by hot pressing in a plurality of molds to obtain a plurality of the integral moldings. Thus, the integral moldings can be mass produced.

In order to further improve acoustic characteristics, particularly, distortion rates and undesirable resonance, damping agents may be applied to the diaphragm and/or edge portion. For instance, when a damping agent is applied to the diaphragm portion 14 or the edge portion 16, unnecessary resonance can be effectively eliminated. Examples of the damping agent include those rubbers set out hereinbefore with respect to FIG. 1. For instance, a solution of a rubber material is dissolved in a solvent therefor and applied to portions of the integral molding which are determined by measurement of the resonance frequencies. The portions to be applied depend on the shape of the molding and the type of material used for the molding. Of course, a rubber film may be applied instead of the rubber solution.

Figure 3:
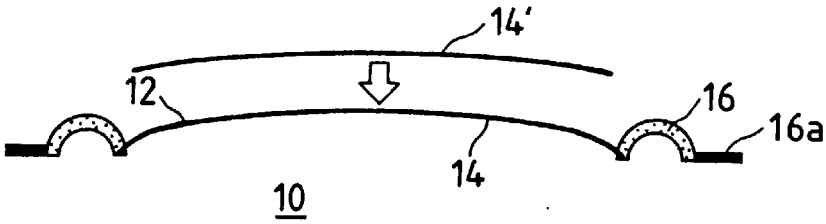
FIG. 3 is similar to FIG. 1 and shows a diaphragm-edge integral molding according to another embodiment of the invention.

Reference is now made of FIG. 3 which shows the integral molding 10 of FIG. 1 on which a reinforcing member or layer 14' is bonded on one side of the molding 10 through a thermoplastic resin impregnated in the molding 10 and the layer 14'although the substrate 14' is depicted as not yet bonded. Examples of the thermoplastic resins include acrylic resins, urethane resins, polyesters, and the like as used in the embodiment of FIG. 1. To fabricate such a composite diaphragm portion, for example, two woven cloth pieces are provided and applied with a thermoplastic polymer resin in different amounts. The cloth pieces with a higher resin content is punched or cut in the form of a diaphragm and superposed on the other cloth piece with a lower resin content, followed by hot pressing to bond the two pieces through the melt of the thermoplastic resin and solidification of the applied resin. In the case, the edge portion is impregnated with a lower content of the resin alone, thus ensuring flexibility. Although different types of resins may be applied to the two cloth pieces, it is preferred that the same resin is used because of the good adhesion between the two cloth pieces. When hot pressed, the diaphragm portion 14 is reinforced with the impregnated diaphragm member 14' having a higher content of the resin, resulting in an integral molding having higher stiffness. This leads to an improvement of acoustic characteristics.

If the above procedure is repeated, a plurality of the impregnated woven cloth pieces can be formed on the diaphragm portion, enabling one to obtain an integral molding having desired high stiffness.

The resin is used in an amount of 5 to 40 g/$m^2$ after drying in the lower content cloth. Only the diaphragm portion 14 of the lower content cloth may be further applied with the resin up to 40 g/$m^2$ in total. For the piece 14', the resin content should be higher than in the diaphragm portion 14 and is generally in the range of 20 to 60 g/$m^2$, within which the resin content in the piece 14' is made higher than in the diaphragm portion 14.

In this embodiment, a thermoplastic resin such as an acrylic resin, a polyurethane or the like may be used for the at least partial impregnation throughout the cloth substrate including the diaphragm and edge portions. The diaphragm portion is reinforced by superposition with at least one diaphragm pattern piece made of an impregnated cloth piece of the same type as the cloth substrate, thereby imparting a desired stiffness to the diaphragm portion. Accordingly, it is not necessarily required to use different types of resins for the diaphragm and edge portions, respectively.

Figure 4:
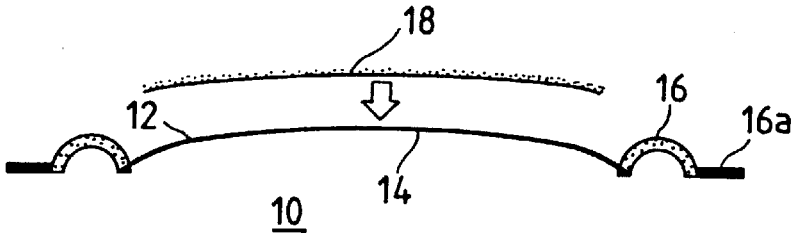
FIG. 4 is a schematic side view of a diaphragm-edge integral molding according to a further embodiment of the invention.

FIG. 4 shows an integral molding as shown in FIG. 1, which has a film 18 of a metal or alloy or diamond by vacuum deposition, sputtering or the like technique. In FIG. 4, the film 18 is depicted as being separate from the diaphragm portion 14 only for illustration and, in fact, is fixedly deposited on the portion 14.

The deposition of a metal or artificial diamond film contributes to reinforcement of the diaphragm portion 14 to impart a desired degree of stiffness thereto. Especially, partial resonance can be effectively suppressed by the formation of the film.

This type of composite diaphragm portion using a metal or alloy film can be made by subjecting an integrally shaped diaphragm-edge article to vacuum deposition using a metal or alloy target under conditions of a reduced pressure of from $10^{-4}$ to $10^{-4}$ Torr., and a temperature of from 40 to 150° C. The film thickness may vary depending on the properties required and is generally in the range of from 1 to 300 $\mu$m. Examples of the metal or alloy useful in the present invention include Cu, Fe, Ni, Zn, Mg alloys and the like, of which Ni is preferred.

With the diamond film, the integrally shaped diaphragm article is subjected, for example, to sputtering using a carbon target at a reduced pressure of $5\times10^{-5}$ to $2\times10^{-4}$ Torr., under conditions of 500 to 1000 eV. The diamond film is deposited to a thickness of 1 to 100 $\mu$m.

Figure 5:
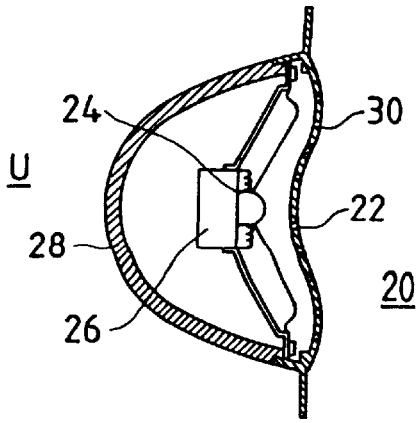
FIG. 5 is a schematic sectional view illustrating a closed type speaker system using a diaphragm-edge integral molding according to the invention.
Figure 6:
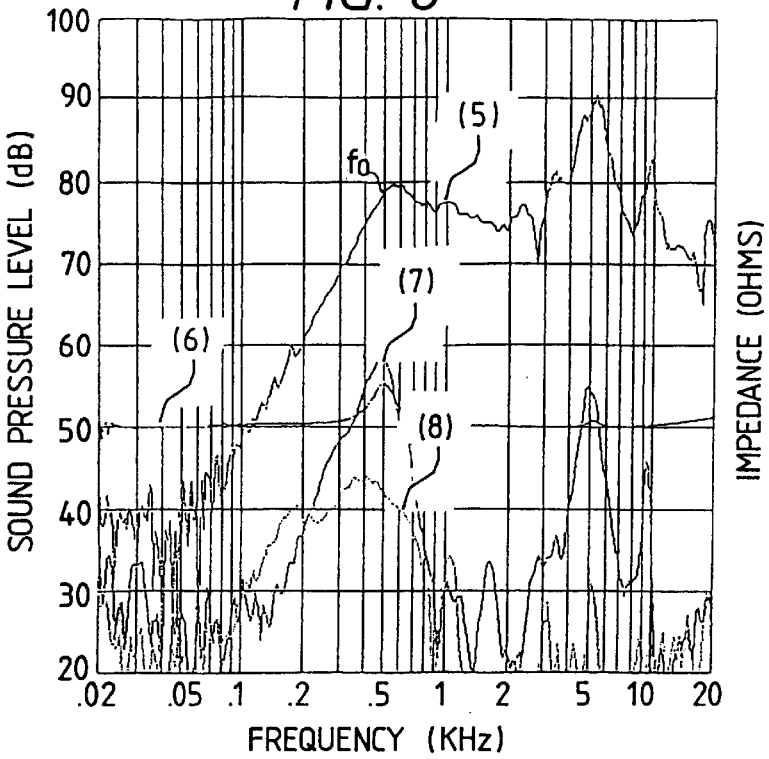
FIGS. 6 to 12 are, respectively, a graphical representation of the sound pressure level in relation to the variation in frequency for different characteristics of the diaphragms of examples of the invention and for comparison.

The diaphragm-edge integral molding of the invention may be used in various types of dynamic speakers including closed-type and open-type speaker systems. For instance, the integral molding of the invention may be applied, for example, to a closed-type dynamic headphone or receiver unit of a telephone set as shown in FIG. 5. In the figure, a receiver unit 20 includes a diaphragm-edge integral molding 22 and a voice coil 24 associated with the molding 22 and mounted on a magnet 26 to provide a speaker unit U. The unit U is encased in a casing 28 closed with a protective member 30. With a receiver, since a digital sampling frequency is 8 kHz, the high-cut frequency is ideally set at 4 kHz. To realize such a high-cut frequency level, the diaphragm portion 14 in the integral molding of the invention can be imparted with an intended level of stiffness. For instance, in the embodiment of FIG. 1, the stiffness can be controlled by properly controlling the amount of the at least partially impregnated polymer resin. Where the high-cut frequency is set at 4 kHz, it is sufficient to impregnate polyethylene terephthalate in an amount, for example, of about 18 g/m$^2$ although the amount may, more or less,e vary depending on the type of resin used. If it is desired to shift the frequency to be set at a higher level, larger amounts of the resin are used. On the contrary, a lower level high-cut frequency can be realized by using smaller amounts of the resin.

By proper control in amount of a thermoplastic resin or a combination of different types of resins or rubbers in the diaphragm and edge portions of the integral moldings according to the foregoing embodiments of the invention, a diaphragm-edge integral molding can be applied to the closed-type speaker system which requires a high-cut frequency at a desired level.

Nevertheless, in a specific embodiment of the invention which is directed only to a closed-type speaker, an integral molding of the invention comprises such an arrangement as set out hereinbefore except that a thermoplastic polymer resin is at least partially impregnated in both a diaphragm portion and an edge portion uniformly throughout the diaphragm and edge portions provided that the flexibility of the edge portion is not impeded. To this end, the resin is impregnated in an amount as small as 10 to 20 g/m$^2$. For the impregnation, the threads for the woven cloth may be coated with a thermoplastic resin, or a thermoplastic resin may be applied to the cloth within the above defined range of amount.

As will be seen from the above, this embodiment differs from the foregoing embodiments in that the edge and diaphragm portions are at the same level of stiffness, but both portions are integrally molded making use of a woven cloth substrate and a thermoplastic resin at least impregnated therein in the diaphragm-edge form. Thus, the use of the diaphragm-edge integral molding according to this embodiment which can be arbitrarily controlled in the high-cut frequency ensures high frequency noises to be cut in transmission systems and circuits, unlike known cutting procedures using electric circuits. This eventually provides clearer sound.

The present invention is more particular described by way of examples which should not be construed as limiting the invention thereto.

EXAMPLE 1

A woven cloth composed of high strength polyethylene threads having a denier of 30 were applied, by screen printing, with 30 g/m$^2$ of a polyurethane resin in a pattern corresponding to a diaphragm portion after molding and also with a 10 g/m$^2$ of an SBR rubber resin in a pattern corresponding to an edge portion after molding, followed by formation of prepreg cloth under conditions of a temperature of 100° C. and then thermoforming press in a mold with a gap being substantially the same as the thickness of the cloth at a temperature of 180° C. under compression pressure conditions of 30 kg/cm$^2$ for 60 seconds to obtain a diaphragm-edge integral molding.

COMPARATIVE EXAMPLE 1

A 50 $\mu$m thick polyethylene terephthalate film was subjected to diaphragm-edge integral molding under conditions of 150° C. at a compression pressure of 30 kg/cm$^2$ for 60 seconds to obtain an integral molding article.

EXAMPLE 2

A woven cloth making use of polyester threads having a denier of 30 was uniformly applied and impregnated with 5 g/m$^2$ of polymethyl methacrylate so that air passage through the impregnated cloth was prevented, and dried. 30 g/m$^2$ of polymethyl methacrylate was further applied, by screen printing, in a pattern corresponding to the diaphragm portion after molding. A separate woven cloth was also applied with 40 g/m$^2$ of polymethyl methacrylate resin by screen printing, followed by punching into the same shape as the pattern. This punched pattern was superposed on the pattern of the first-mentioned woven cloth, followed by drying and setting in a mold having a gap substantially equal to the thickness of the superposed portions. The thus set woven cloth was subjected to thermoforming press at a mold temperature of 180° C. under a compression pressure of 30 kg/cm$^2$ for 60 seconds to obtain a diaphragm-edge integral molding for speaker.

EXAMPLE 3

A woven cloth composed of polyester threads having a denier of 30 was applied, by screen printing, with 30 g/m$^2$ of polymethyl methacrylate in a pattern corresponding to a diaphragm portion after molding and with 10 g/m$^2$ of a urethane resin in a pattern corresponding to an edge portion after molding, followed by formation of prepreg cloth at a temperature of 100° C. and thermoforming press at a mold temperature of 180° C. under a compression pressure of 30 kg/cm$^2$ for 60 seconds, thereby obtaining a diaphragm-edge integral molding for speaker.

EXAMPLE 4

A woven cloth composed of polyester threads, which had been individually applied with 10 g/m$^2$ of polymethyl methacrylate resin during the course of spinning as having an outer layer of the resin, was provided. The cloth was applied with an epoxy resin by screen printing in a pattern corresponding to a diaphragm portion after molding. The thus applied cloth was subjected to thermoforming press with a mold gap corresponding to the thickness of the cloth at a mold temperature of 180° C. under a compression pressure of 30 kg/cm$^2$ for 60 seconds, thereby obtaining a diaphragm-edge integral molding.

EXAMPLE 5

A woven cloth composed of polyester threads was impregnated with 20 g/m$^2$ of an acrylic resin and dried. The dried cloth was subjected to thermoforming press in a mold having a molding space determined to take the thickness of the impregnated cloth into consideration, under conditions of a temperature of 180° C. and a compression pressure of 60 kg/cm$^2$ for 30 seconds, thereby obtaining a diaphragm-edge integral molding for closed-type speaker.

COMPARATIVE EXAMPLE 2

A 50 $\mu$m thick polycarbonate film was subjected to thermoforming press in a diaphragm-edge pattern under conditions of 150° C. and 30 kg/cm$^2$ for 60 seconds, thereby obtaining an integrally molded film for closed-type speaker.

The diaphragm-edge moldings obtained in Examples 1 to 4 and Comparative Example 1 were each subjected to measurement of sound pressure-frequency characteristic as an open-type speaker unit according to the method described in JIS-C5531 to determine frequency, impedance, secondary distortion and tertiary distortion characteristics. The diaphragm-edge moldings of Example 5 and Comparative Example 2 were also subjected to measurement of sound pressure-frequency characteristic as a closed-type speaker unit according to the method described in JIS-C5531 and using an IEC-318 coupler (artificial ear) of B & K Co., Ltd. to determine frequency, impedance, secondary distortion and tertiary distortion characteristics.

The results of the measurements are shown in FIGS. 6 to 12, in which curves (5), (6), (7) and (8), respectively, indicate frequency characteristic, impedance characteristic, secondary distortion characteristic and tertiary distortion characteristic.

Figure 7:
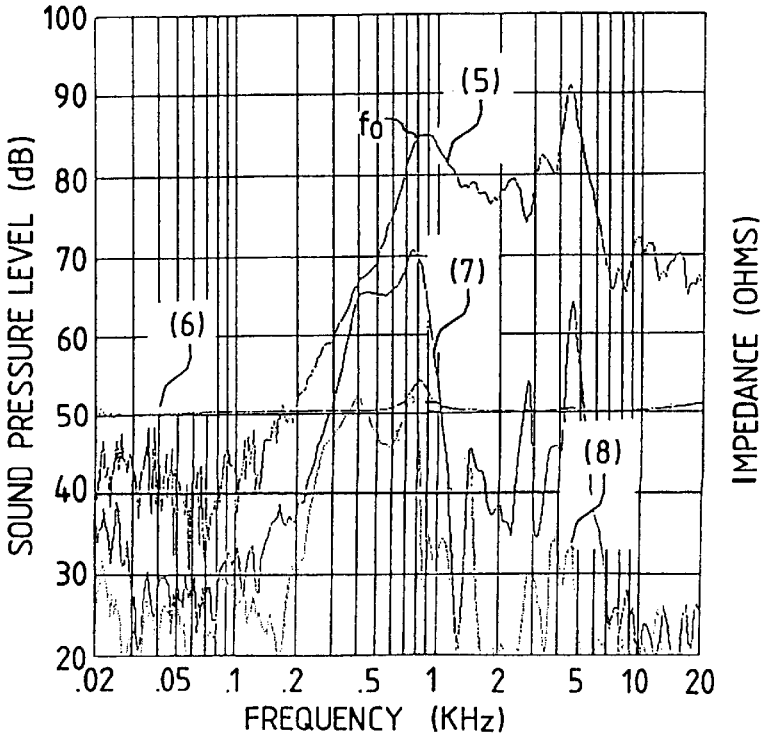
Figure 8:
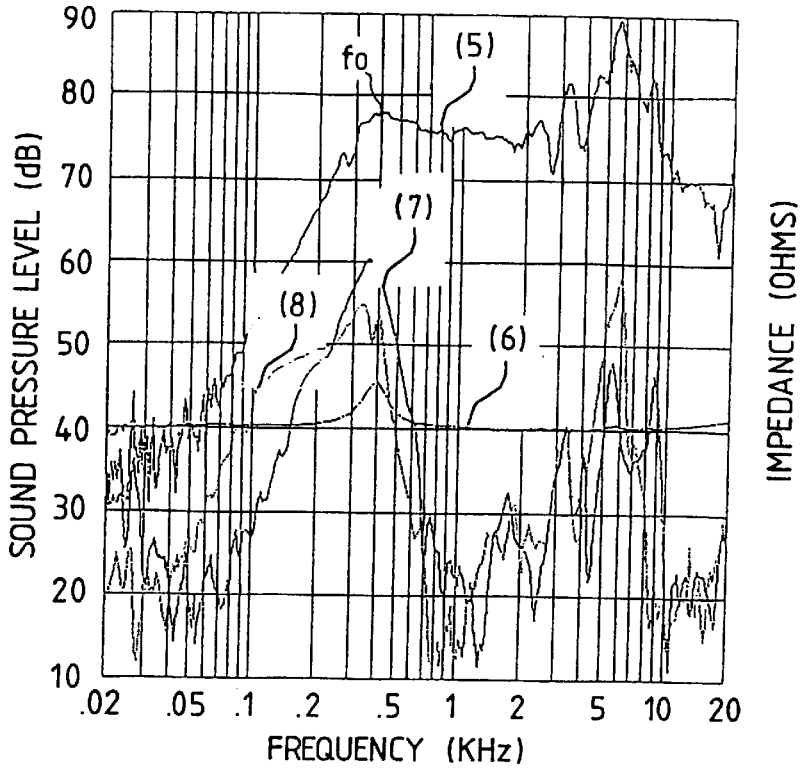
Figure 9:
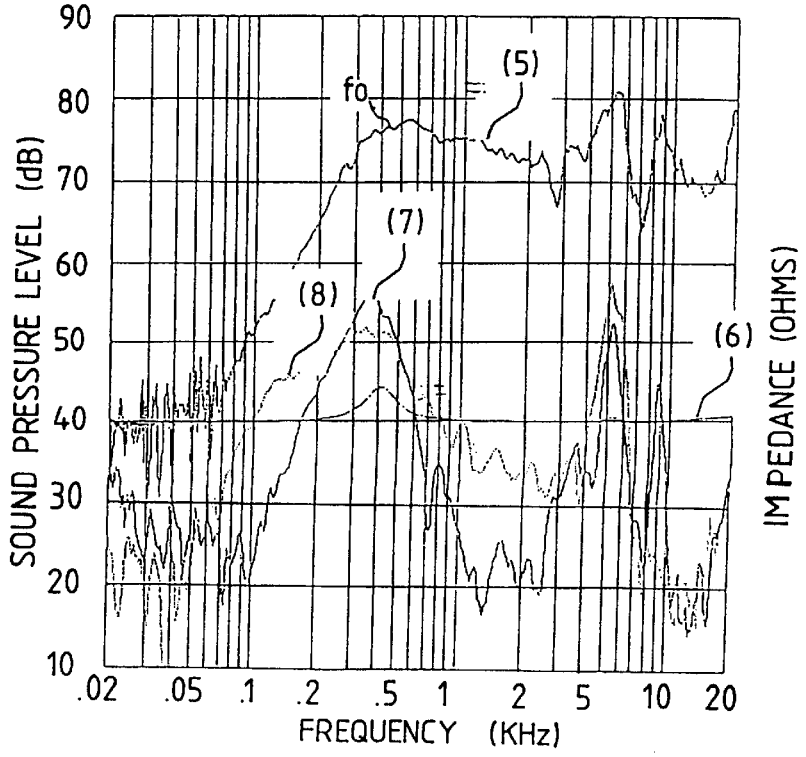
Figure 10:
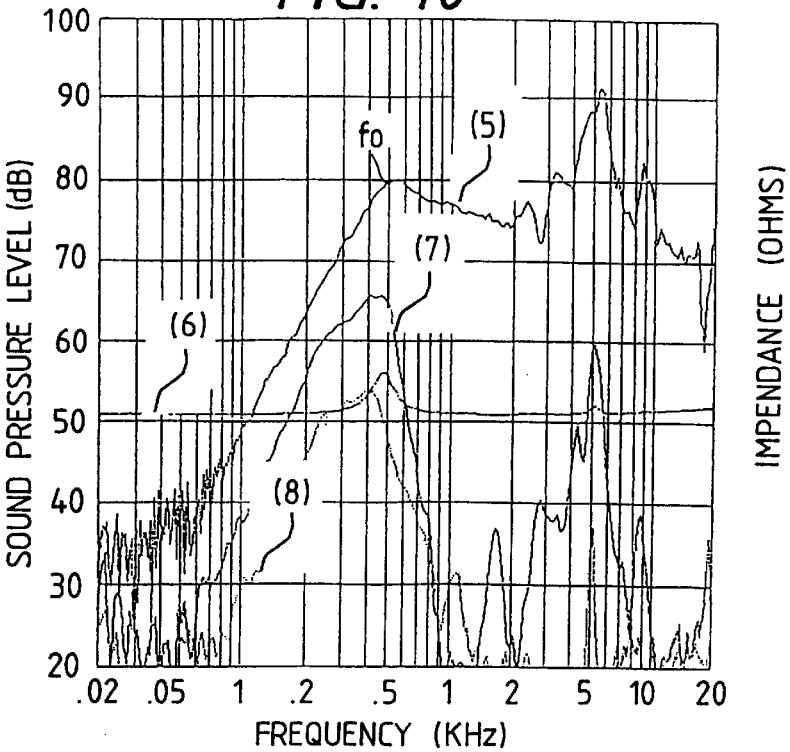

As will be apparent from the comparison between the results shown in FIGS. 7 and 8 which, respectively, deal with the integral molding of Example 1 and Comparative Example 1, the minimum resonance frequency, $f_o$, of Comparative Example 1 is 800 Hz, whereas with Example 1, the minimum resonance frequency is as low as 500 Hz. The high-band threshold frequency, $f_h$, is about 4.5 kHz for Comparative Example 1 and is about 5.5 kHz for Example 1. Thus, the integral molding of Example 1 can realize a wider frequency band owing to the lowering in stiffness of the edge portion and the increase in stiffness of the diaphragm portion. Moreover, the distortions in the vicinity of $f_o$ is lower than in the comparative example although the value of $f_o$ lowers, resulting in lowerings of the distortions. This is considered to result not only from the towering in stiffness of the edge portion, but also tom the high internal loss of the cloth substrate.

The minimum resonance frequency, high-band threshold frequency and distortion at $f_o$ of the moldings of Examples 1 to 4 and Comparative Example 1 are shown below.

| | minimum resonance frequency | high-band threshold frequency | distortion at $f_0$ |
|---|---|---|---|
| Example 1 (FIG. 6) | 500 Hz | 6.0 kHz | −22 dB |
| Example 2 (FIG. 8) | 400 Hz | 5.5 kHz | −18 dB |
| Example 3 (FIG. 9) | 400 Hz | 5.5 kHz | −20 dB |
| Example 4 (FIG. 10) | 400 Hz | 5.5 kHz | −15 dB |
| Comp. Ex. 1 (FIG. 7) | 800 Hz | 4.5 kHz | −14 dB |

Figure 11:
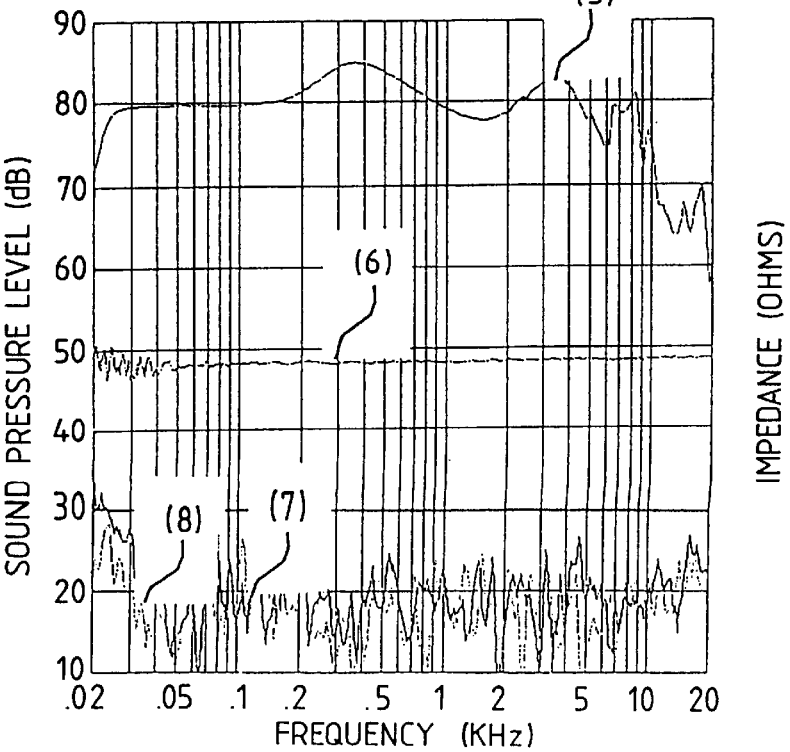
Figure 12:
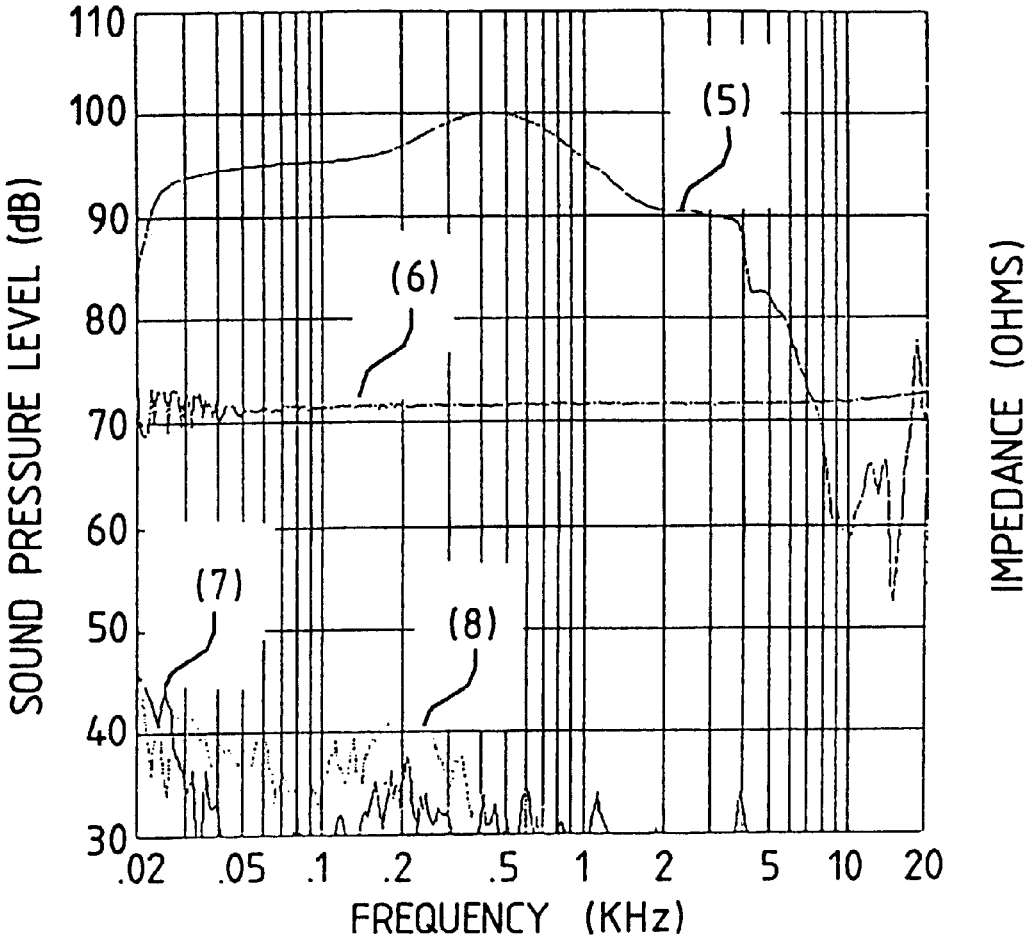

The results of the measurement for the closed-type speaker units using the moldings of Comparative Example 2 and Example 6 are shown in FIGS. 11 and 12, respectively. With the molding of Comparative Example 2, reproduction is possible to a level of 10 kHz and high frequency noises are generated as shown. For the closed type speaker, the transmission band is up to 3.4 kHz, so that the molding of the example is controlled to lower in the frequency range of 3 to 4 kHz.

EXAMPLE 6

The general procedure of Example 1 was repeated thereby obtaining a diaphragm-edge integral molding. Thereafter, the molding was subjected to vacuum deposition using Ni in an atmosphere of Ar at a reduced pressure of $10^{-5}$ Torr., to form a vacuum deposition film on one side of the molding in a thickness of 10 $\mu$m.

EXAMPLE 7

The general procedure of Example 1 was repeated thereby obtaining a diaphragm-edge integral molding. Thereafter, the molding was subjected to sputtering of diamond in an atmosphere of Ar at a reduced pressure of $10^{-5}$ Torr., to form a diamond film on one side of the molding in a thickness of 10 $\mu$m.

We claim:

1. A diaphragm for speakers which comprises a self-supporting, shaped body including a tightly woven synthetic polymer fiber cloth substrate which has, at least, a diaphragm portion and an edge portion shaped integrally with and extending from said diaphragm portion wherein said diaphragm portion and said edge portion have a thermoplastic polymer resin at least partially impregnated thereto in different amounts, respectively, so that said edge portion is lower in stiffness than said diaphragm portion, said thermoplastic resin is present in said edge portion in an amount of 5 to 20 g/m$^2$ and in said diaphragm portion in an amount of 15 to 50 g/m$^2$ provided that said edge portion has a resin content less than said diaphragm portion.

2. A diaphragm according to claim 1, wherein said cloth substrate consists of polyester fibers.

3. A diaphragm according to claim 1, wherein said cloth substrate consists of polyamide fibers.

4. A diaphragm according to claim 1, wherein said thermoplastic resin is an acrylic resin.

5. A diaphragm according to claim 1, wherein said thermoplastic resin is a urethane resin.

6. A diaphragm according to claim 1, further comprising a reinforcing layer formed on said diaphragm portion in a pattern corresponding to said diaphragm portion.

7. A diaphragm according to claim 6, wherein said reinforcing layer is made of a tightly woven synthetic polymer fiber cloth impregnated with a thermoplastic resin.

8. A diaphragm according to claim 7, wherein said reinforcing layer is made of a plurality of the impregnated polymer fiber cloth pieces.

9. A diaphragm according to claim 6, wherein said reinforcing layer consists of a film of a metal or alloy vacuum deposited on said diaphragm portion.

10. A diaphragm according to claim 6, wherein said reinforcing layer consists of artificial diamond.

11. A diaphragm according to claim 1, wherein said cloth substrate is made of fibers individually coated with a thermoplastic polymer when spun.

12. A diaphragm according to claim 1, wherein a damping agent is applied to said shaped body whereby unnecessary resonance is eliminated.

13. An acoustic transducer which comprises an acoustical driving means and a diaphragm driven by the driving means, said diaphragm comprising a self-supporting, shaped body including a tightly woven synthetic polymer fiber cloth substrate which has, at least, a diaphragm portion and an edge portion shaped integrally with and extending from said diaphragm portion, wherein said diaphragm portion of said cloth substrate has a polymer resin at least partially impregnated thereto in order to impart stiffness to said diaphragm portion and said edge portion has a flexible polymer material at least partially impregnated therein so that said edge portion is lower in stiffness than said diaphragm portion, said flexible polymer material is present in said edge portion in an amount of 5 to 20 g/m$^2$ and said polymer resin in said diaphragm portion is in an amount of 15 to 50 g/m$^2$ provided that said edge portion has a resin content less than said diaphragm portion.

14. An acoustic transducer according to claim 13, wherein said driving means is a moving coil.

* * * * *